US005765411A

United States Patent [19]

Rowan

[11] Patent Number: 5,765,411

[45] Date of Patent: Jun. 16, 1998

[54] FENCE LOCK

[76] Inventor: William Rowan, 1176 Rowayton Cir., West Palm Beach, Fla. 33414

[21] Appl. No.: 589,729

[22] Filed: Jan. 22, 1996

Related U.S. Application Data

[63] Continuation-in-part of Ser. No. 278,381, Jul. 20, 1994, abandoned.

[51] Int. Cl.[6] ..... E05B 65/06

[52] U.S. Cl. ..... 70/134; 70/142; 70/451; 70/461; 70/DIG. 64; 70/DIG. 60

[58] Field of Search ..... 70/131, 134, 142, 70/145, 448, 451, 461, DIG. 60, DIG. 64; 292/DIG. 60, 165, 346

[56] References Cited

U.S. PATENT DOCUMENTS

| | | | |
|---|---|---|---|
| 1,325,919 | 12/1919 | Voight | 292/340 |
| 1,790,422 | 1/1931 | Holtzman | 70/131 |
| 2,415,264 | 2/1947 | Sutphin | 292/169.18 |
| 2,518,207 | 8/1950 | Wagner | 292/337 |
| 3,821,884 | 7/1974 | Walsh | 70/417 |
| 3,964,281 | 6/1976 | Shipman | 70/134 |
| 4,157,653 | 6/1979 | Dohanyos | 70/134 |
| 4,313,320 | 2/1982 | Best et al. | 70/134 |
| 4,565,079 | 1/1986 | Smith | 70/451 |
| 4,691,948 | 9/1987 | Austin, Jr. et al. | 292/171 |
| 5,447,046 | 9/1995 | Duffus | 70/DIG. 64 |

FOREIGN PATENT DOCUMENTS

| | | | |
|---|---|---|---|
| 2063981 | 6/1981 | United Kingdom | 70/DIG. 60 |

*Primary Examiner*—Darnell M. Boucher
*Attorney, Agent, or Firm*—Malin, Haley, DiMaggio & Crosby

[57] ABSTRACT

A security bar that can be retrofitted onto a gate used in a typical fence construction to prevent unauthorized tampering with or opening of the gate. The device includes a rigid locking bar that is firmly mounted to the gate, a T-shaped strike plate, and a key-actuated latchbolt mechanism mounted within the inside of the rigid locking bar so that the latchbolt and strike plate cannot be accessed for tampering. The strike plate is mounted to a conventional fence post with fasteners that are not accessible when the gate is closed. Using the present device, which can be retrofitted to any type of outdoor gate, a positive locking action insures that the gate is locked at all times and cannot be jimmied or pulled upward to a position that would allow it to be opened. The locking mechanism allows access from either side of the gate for actuation.

7 Claims, 8 Drawing Sheets

FENCE LOCK

This is a continuation-in-part of application Ser. No. 08/278,381, filed Jul. 20, 1994.

BACKGROUND OF THE INVENTION

1. Field of the Invention

This invention relates to an improved fence lock, and more particularly to a locking device designed for installation on chain-link, aluminum tube, ornamental iron, and wood gates not having a top header to maintain the stability of the two side jambs. The device is so designed so that when locked, the latch mechanism surrounds the strike, making it very unlikely that separation could occur due to the lifting of the door or forced spreading of the jamb and door.

2. Description of the Prior Art

Securing devices for gates are known in the prior art. U.S. Pat. No. 392,297, issued Nov. 6, 1888 to W. R. White, shows a securing device for gates having a lock to hold a gate latch against movement on its pivot when in normal engagement with the catch of a locking post, and a lock to continue the gate in such closed position when the latch is released from its catch by the upward movement of the gate. U.S. Pat. No. 2,373,783, issued Feb. 6, 1944 to F. Schlifer, shows a locking mechanism preferably having a bar which may be situated on the inside of a door or window, and that can be locked from either within or without, and opened correspondingly. U.S. Pat. No. 3,896,588, issued Jul. 29, 1975 to Doffin et al., shows a combined gate hinge and latch assembly, whereby a gate member may be swung between the open and closed positions from either end of the gate, and further wherein the gate is readily removable from an associated fence post. U.S. Pat. No. 4,330,147, issued May 18, 1982 to Nolen, shows a locking bar for doors, from the inside, having an adjustable length bar which includes a cylinder lock for preventing the bar from being removed from the door except by authorized persons within the dwelling or other structure. U.S. Pat. No. 4,512,105, issued Apr. 23, 1985 to Norton, shows a gate latch which is strong enough to hold large animals, and which, when locked, is difficult to release by tampering.

One of the chief drawbacks of the securing devices for gates shown in the prior art is that the frame that the gate fits into is relatively easy to be pried apart or jimmied because of the flexibility within the gate. Another problem with the securing devices for gates shown in the prior art is that they are not positive locking devices.

The present invention overcomes the problems shown in the prior art by providing a locking mechanism especially suited for a gate or other movable closure to insure a positive locked gate that cannot be tampered with or forcibly lifted on the latch side to gain access to the area being fenced in.

SUMMARY OF THE INVENTION

A locking mechanism especially suited for a gate or other movable closure supported between two rigid, vertical posts typically found with fences, such as chain-link fences, to insure a positive locked gate that cannot be tampered with or forcibly lifted on either side to gain access.

The locking mechanism is especially useful as a gate latching device for gates that are movably disposed between a pair of rigid, vertical posts mounted in the earth.

The gate-mounted positive locking device in accordance with the present invention is comprised of two independent mechanisms, the first being a rigid, hollow bar that is mounted on the gate, and the other of which is a strike plate assembly mounted on one of the fence posts and functioning as the gate latch receiver.

The gate-mounted device includes a very rigid, substantially rectangular, hollow bar that is preferably telescopically adjustable in length, and that substantially fits laterally across a predetermined portion of the gate for rigid attachment thereto. The bar is sturdy and not easily deformable and may be made of rigid aluminum or the like. The bar functions to house a cylinder lock, a retracting pawl mechanism mounted inside the hollow, rigid bar a predetermined distance from the gate end serving as the latch, a latchbolt disposed within the elongated, rigid bar, and a latchbolt housing rigidly mounted within the locking bar at a predetermined position relative to a single locking aperture disposed in one side of the locking bar. The latchbolt is mounted in the latchbolt housing and moves in the same direction as the longitudinal axis of the locking bar. A retracting bar is connected between the latchbolt housing and the retracting pawl, wherein the latchbolt housing includes a spring mechanism therein so that the latchbolt is sprung to be in a closed position while being able to be moved in a direction away from the gate latch area by actuation of a key in a cylinder lock, as described below. When the key is placed in the cylinder lock and turned, a retracting lever pivots and engages a retracting lever engaging pin which is disposed through and frictionally engages the retracting pawl, thereby causing the retracting pawl to pivot about a retracting pawl pivot and aligning tube, thereby causing the retracting bar to exert a force or tension on the spring mechanism in the latchbolt housing, causing the latchbolt to retract in a direction away from the gate latch. An aligning pin is also provided to prevent an individual from turning the cylinder housing with a wrench, pliers, etc., thereby preventing the individual from unlocking the device by breaking the cylinder housing.

The second component necessary for the invention is a strike plate that has mounting apertures therein such that when the strike plate is properly mounted firmly and rigidly to the vertical fence post, the strike plate, having a protruding portion with a latchbolt receiving aperture, can, through movement of the gate itself and the rigid bar attached thereto, achieve an engaging and positive locking position, whereby the latchbolt slides on the strike plate until it is perfectly positioned, where it extends by spring tension into the strike plate or latchbolt receiving aperture, such that the latch mechanism surrounds the strike, causing the device to be in a positive locked mode.

The strike plate itself may be a T-shaped plate made of rigid material such as aluminum, and includes a plurality of apertures that are used with fasteners such as bolts or screws to mount the strike plate at a predetermined height that is parallel and in the same plane as the rigid bar on the gate to insure engagement of the latchbolt in the latchbolt receiving aperture on the strike plate. The T-shaped configuration, having legs of a predetermined length forming the "T" and a predetermined length of the entire T-shaped plate as it fits parallel on a rigid fence post, which also may be made of aluminum, insures that certain of the fasteners are blocked to prevent removal so that the strike plate cannot be removed when the gate is in a locked position.

By virtue of actuating a cylinder lock with a key, which can be accessed from either side of the gate so that there is a double cylinder key actuated lock from each side of the gate, rotation of a key within either of the cylinder locks causes the pawl to be rotated which has a linking mechanism connected directly to the latchbolt that is spring locked. This will withdraw the latchbolt against the spring tension a sufficient distance to be removed from the strike plate aperture, allowing the gate to swing open and the strike plate and aperture to be removed from the entire lock bar housing. Note that due to the thickness of the lock bar housing, in the locked mode, the strike plate is inserted within a portion of the locking bar housing, making the latchbolt and strike plate aperture inaccessible to someone who would attempt to tamper with the device.

This device can be readily mounted on existing gates such as chain-link fence gates and chain-link fences that are found around owners' properties, tennis courts, and other areas where it is desired that unauthorized access be prevented. The locking bar itself is telescopic in length, having a nylon or PVC bushing or sleeve at the end of the bar opposite the latch so that it can fit between the gate posts that form the gate vertically on each side so that the locking bar itself is rigidly mounted thereto. The locking bar housing includes elongated apertures to allow for slidable adjustment of the fasteners as they are received through the gate posts that form the structure of the gate on each side vertically. Fasteners must be attached to the gate post to firmly attach the bar in place. Typically, however, the distance between the fence post and the gate post is not always the same from fence to fence. Because the second component necessary for the invention is a strike plate that is mounted to a fence post, it is necessary to have a degree of adjustability regarding the fasteners of the locking bar. By virtue of having the inside fasteners that can slide to adjust to different widths between the gate post and the fence post, the fasteners can be adjusted accordingly. This allows for a perfect fit of the locking bar to the gate itself, and further allows for the proper spacing between the single locking bar aperture and the strike plate assembly to which the locking bar aperture mates, the striker plate assembly being mounted to one of the fence posts.

Once the striker plate assembly has been mounted to one of the two fence posts that define and mount the gate therein, and the gate locking bar has been secured to the gate itself, the device is ready for operation. With a positive locking spring tension on the latchbolt, the user must engage a key to open the gate at all times.

In an alternate embodiment of the present invention, the cylinder locks thread into an internal rigid member through elongated apertures in the hollow rigid bar. The latchbolt is mounted to one end of the internal rigid member. The internal rigid member is substantially rectangular in shape and is sized to slide longitudinally in the rigid hollow bar. The internal rigid member holds the latchbolt and cylinder locks, and the combination is held in place by an endcap having fixed positioning members, or spacers.

To disassemble the device, the endcap is first removed. The internal rigid member/cylinder lock/latchbolt assembly is then slid inside the hollow rigid bar toward the end nearest the removed endcap, (the latchbolt end). The assembly slides until stopped by the cylinder locks' contact with the edge of the elongated apertures in the hollow rigid bar. Recessed set screws, which must be removed to allow the cylinder locks to be unthreaded, are thereby uncovered. The recessed set screws, one for each cylinder lock, are hidden by the edges of the cylinder locks during use of the device, and are only exposed when the rigid member/cylinder lock/latchbolt assembly is slid toward the latchbolt end. Once the set screws are removed, the cylinder locks can be unthreaded and removed, permitting the internal rigid member to be slid completely out of the hollow bar. Assembly is the reverse of these steps, ending with insertion of the endcap which fixes the position of the internal assembly.

In the embodiment just described, the cylinder locks are connected to the latchbolt by a rigid linkage member that fits into a recessed area on the internal rigid member. The rigid linkage member is connected to the moveable portion of the latchbolt. The recessed portion of the internal rigid member allows the rigid linkage member to slide longitudinally for the full movement of the latchbolt mechanism. When a key is rotated in either cylinder lock, a lever on the inside of the cylinder rotates against one end of the rigid linkage member thereby pulling the linkage and opening the latchbolt. As in the previous embodiment, an internal spring mechanism keeps the latchbolt in the closed position when the key is released.

It is an object of this invention to provide a security device for positively locking gates typically found with fences to prevent unauthorized access through the gate by virtue of tampering with or prying the gate mechanism.

It is another object of this invention to provide a positive locking mechanism for a gate that can be readily installed on existing gates and fences to prevent unauthorized access through the gate.

But yet still another object of this invention is to provide a retrofit locking and latch mechanism for a movable closure typically found between posts, such as gates, that can prevent unauthorized opening of the gate using cylinder locking mechanisms and the like.

And yet still another object of the invention is to provide a locking bar for a gate that cannot be tampered with or jimmied open and prevents access to the locking mechanism itself in the locked position.

In accordance with these and other objects which will become apparent hereinafter, the instant invention will now be described with particular reference to the accompanying drawings.

DESCRIPTION OF THE PREFERRED EMBODIMENTS

Figure 5B:
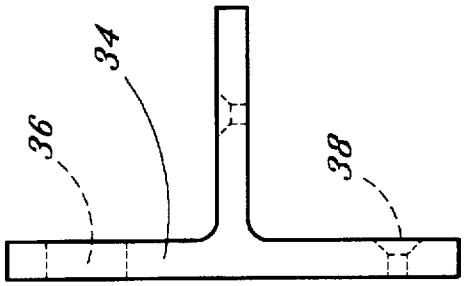
FIG. 5B is a side elevational view of the strike plate of the instant invention.
Figure 5A:
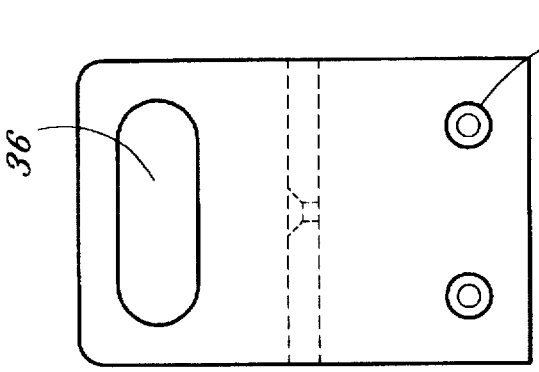
FIG. 5A is a front elevational view of the strike plate of the instant invention.

Referring now to FIGS. 1–5B, there is shown an improved fence lock, generally designated by reference numeral 10. The gate-mounted device includes a rigid, hollow bar 12, telescopically adjustable in length, that substantially fits laterally across a predetermined portion of the gate 11 for rigid attachment thereto. The bar 12 is sturdy and not easily deformable and may be made of rigid aluminum or the like. The bar 12 functions to house a cylinder lock 14, a pawl lock mechanism 16 mounted inside the hollow bar 12 a predetermined distance from the gate end serving as the latch, a latchbolt 18 disposed within the elongated bar 12, and a latchbolt housing 20 rigidly mounted within the hollow bar 12 at a predetermined position relative to a locking aperture 22 disposed in one side of the locking bar 12. The latchbolt 18 is mounted to move in the same direction as the longitudinal axis of the bar 12 and includes a spring mechanism (not shown) so that the latchbolt 18 is sprung to be in a closed position while being able to be moved in a direction away from the gate latch area by actuation of a key 42 in cylinder lock 14.

The improved fence lock 10 can be readily mounted on existing gates such as fence gates 11 that are found around owners' properties, tennis courts, and other areas where it is desired that unauthorized access be prevented. The locking bar 12 is telescopically adjustable in length, having sleeve 56 and telescopic portion 58 at the end of the bar opposite the latch so that the locking bar 12 can fit between the gate posts **24*a*, 24*b* that form the gate vertically on each side so that the locking bar 12 is rigidly mounted thereto. The locking bar 12 includes elongated apertures 26 to allow for slidable adjustment of fasteners 28 as they are received through gate post 24*a*. Fasteners 28 must be attached to the gate post 24*a* to firmly attach the locking bar 12 in place. Typically, however, the distance between fence post 30*a* and gate post 24*a* is not always the same from fence to fence. Because a second component necessary for the invention is a strike plate 32 that is mounted to fence post 30*a*, it is necessary to have a degree of adjustability regarding the fasteners 28 of the locking bar 12. By virtue of having the fasteners 28 being slidably adjustable to adjust to different widths between gate post 24*a* and fence post 30*a*, the locking bar 12 is assured of a perfect fit to the gate itself, and further, the proper spacing between the locking aperture 22 and the strike plate assembly 32 to which the locking bar aperture 22** mates is maintained.

Figure 1:
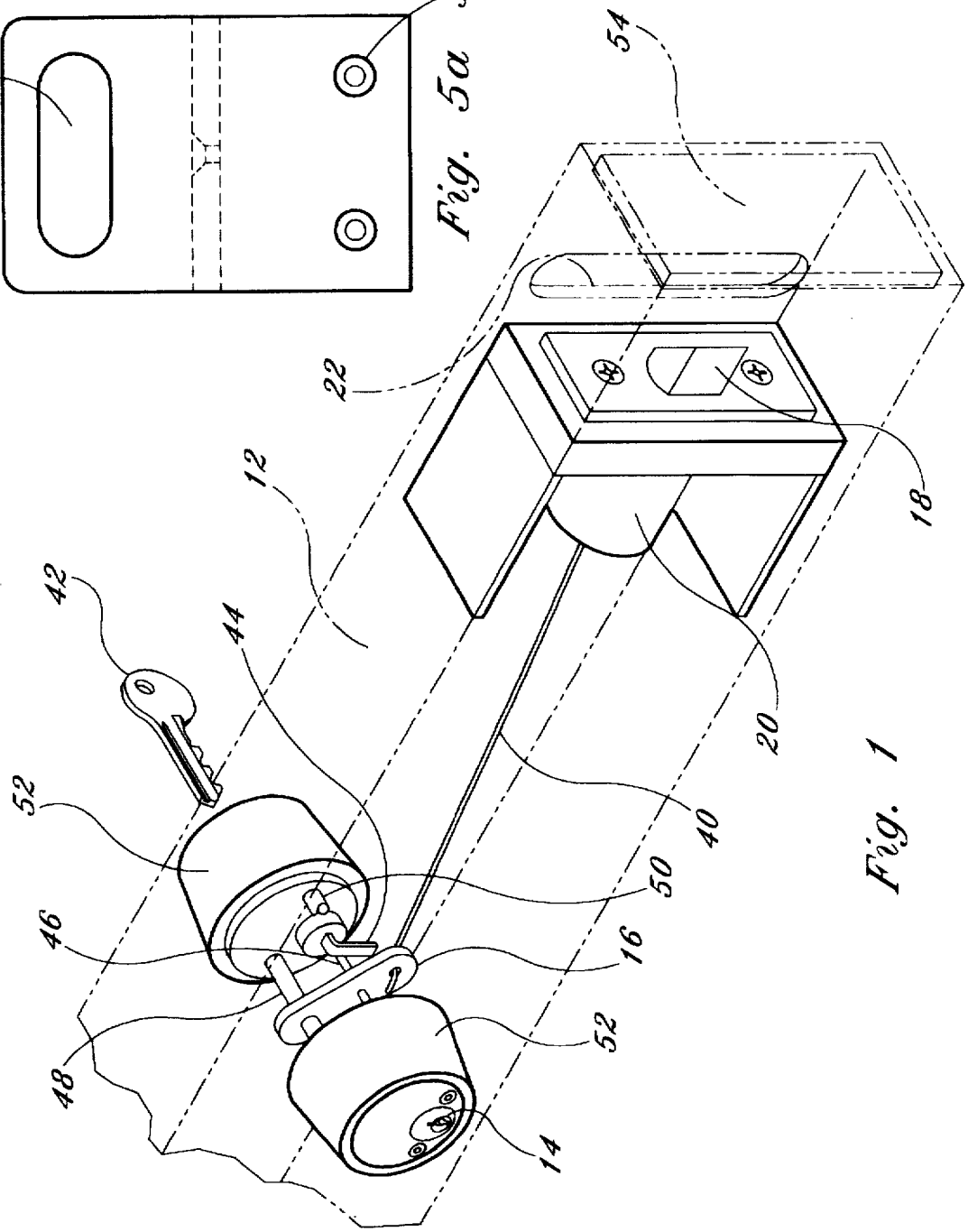
FIG. 1 is a perspective view, partially cut away, in phantom that shows the cylinder lock, the pawl, and the latchbolt housing and latchbolt used in the present invention.
Figure 2:
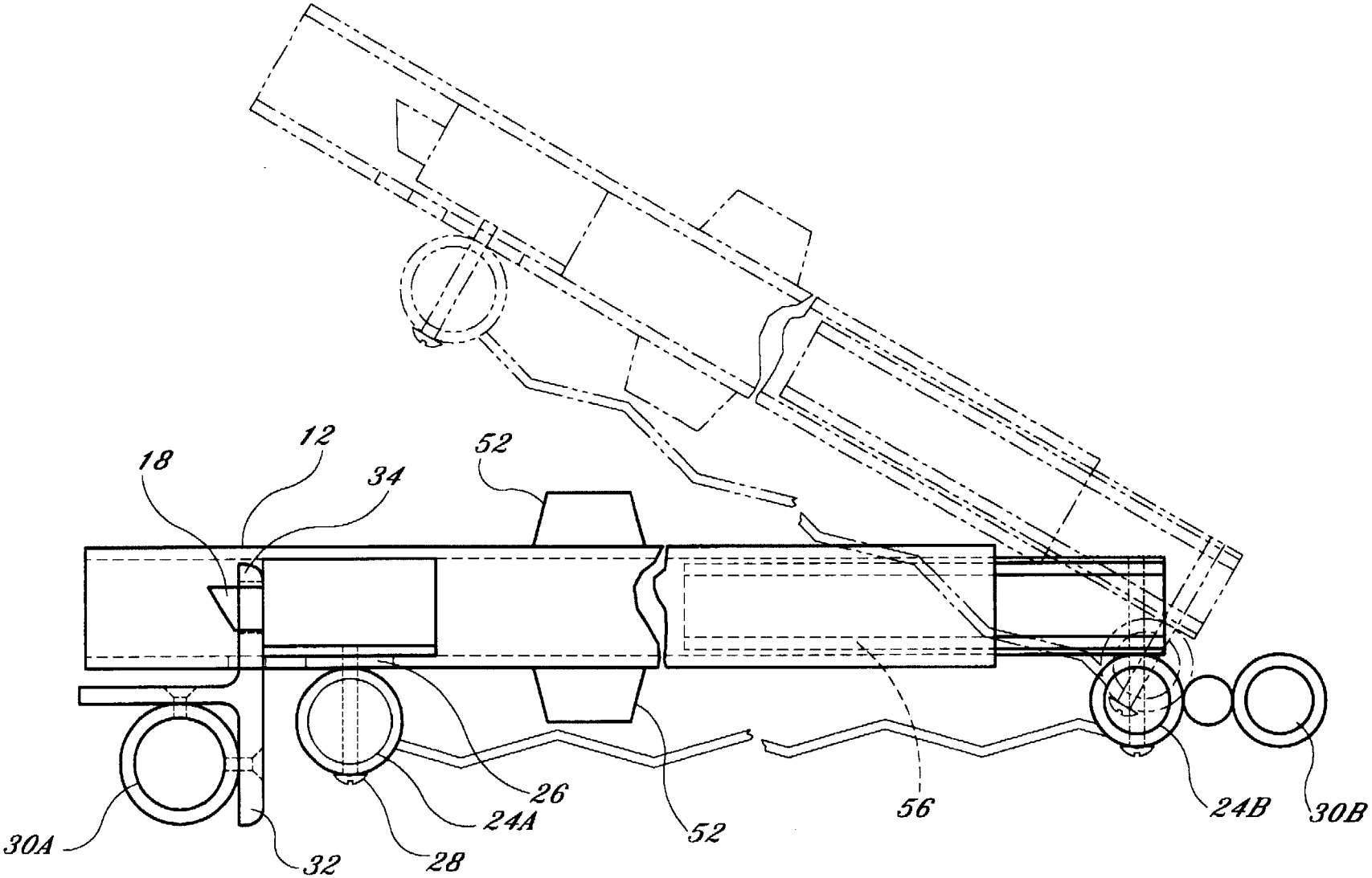
FIG. 2 is a top plan view, partially cut away, in phantom that shows the device attached to the gate posts with the gate swinging between the open and closed positions.

As seen in FIG. 1, the locking bar 12 houses a cylinder lock 14, a retracting pawl mechanism 16 mounted inside the hollow, rigid bar 12 a predetermined distance from the gate end serving as the latch, a latchbolt housing 20 rigidly mounted within the locking bar 12 at a predetermined position relative to locking aperture 22, and latchbolt 18 mounted with the latchbolt housing 20, the latchbolt 18 moving in the same direction as the longitudinal axis of the locking bar 12. Retracting bar 40 is connected between latchbolt housing 20 and retracting pawl 16. When the key 42 is placed in cylinder lock 14 and turned, retracting lever 44 pivots and engages retracting lever engaging pin 46, thereby causing retracting pawl 16 to pivot about retracting pawl pivot and aligning tube 48, thereby causing the retracting bar 40 to exert a force or tension on the spring mechanism in the latchbolt housing 20, causing the latchbolt 18 to retract in a direction away from the gate latch. Removable end cap 54 is provided at the ends of the bar 12 for service. An aligning pin 50 is also provided to prevent an individual from turning the cylinder housing 52 with a wrench, pliers, etc., thereby preventing the individual from unlocking the device by breaking the cylinder housing 52.

The second component necessary for the instant invention is strike plate assembly 32 that has mounting apertures 38 therein such that when the strike plate is properly mounted firmly and rigidly to the vertical fence post **30*a*, the strike plate assembly 32 having a protruding portion 34 with a latchbolt receiving aperture 36, can, through movement of the gate 11 and the locking bar 12 attached thereto, achieve an engaging and locking position, whereby the latchbolt 18 slides on the striker plate assembly 32 until it is perfectly positioned, where it extends by spring tension into the latchbolt receiving aperture 36**, causing the device to be in a locked position.

The strike plate assembly 32 may be a T-shaped plate made of rigid material, such as aluminum, and include a plurality of mounting apertures 38 that are used with fasteners, such as screws, bolts, or the like, to mount the strike plate assembly 32 at a predetermined height that is parallel and in the same plane as the locking bar 12 on the gate 11 to insure engagement of the latchbolt 18 in the latchbolt receiving aperture 36. The T-shaped configuration of strike plate assembly 32, having legs of predetermined length with beveled edges, insures that certain of the fasteners are blocked to prevent removal so that the strike plate assembly 32 cannot be removed when the gate 11 is in the locked position.

By virtue of actuating cylinder lock 14 with a key 42, which can be accessed from either side of the gate 11 so that there is a double cylinder key actuated lock from each side of the gate 11, rotation of key 42 within the cylinder lock 14 causes the pawl lock mechanism 16 to be rotated which has retracting bar 40 connected directly to the latchbolt 18 that is spring-locked. Rotation of the key 42 within the cylinder lock 14 will withdraw latchbolt 18 against the spring tension a sufficient distance to be removed from the latchbolt receiving aperture 36, allowing the gate 11 to swing open and the strike plate assembly 32 to be removed from the locking bar 12. It is also contemplated that a solenoid be connected to the rigid bar and the linkage means for remote controlled operation of the locking latchbolt mechanism.

Referring now to FIGS. 6A–10, an alternate embodiment of the present invention is shown. In the alternate embodiment, shown in FIGS. 6A–9, threaded portion 61 of cylinder locks 60 thread into threaded apertures 63 in internal rigid member 62 through elongated apertures 64 in hollow rigid bar 66. Latchbolt 68 is mounted to one end of internal rigid member 62. Internal rigid member 62 is substantially rectangular in shape and is sized to slide longitudinally in rigid hollow bar 66. Internal rigid member 62 holds latchbolt 68 and cylinder locks 60, and the combination, shown generally as 70, is held in place by endcap 72 having fixed positioning members, or spacers 74.

Latchbolt 68 is a safety latchbolt such that, in the closed position, the latch functions similar to a deadbolt and cannot be pried open.

Figure 6A:
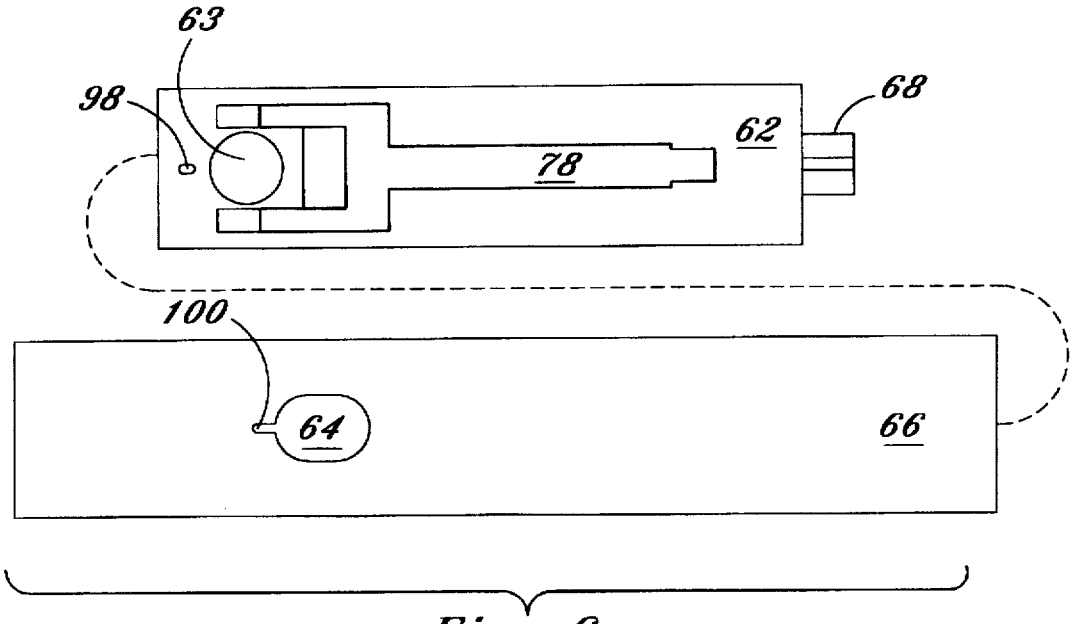
FIGS. 6A–C are front elevational assembly views of an alternate embodiment of the present invention.
Figure 6B:
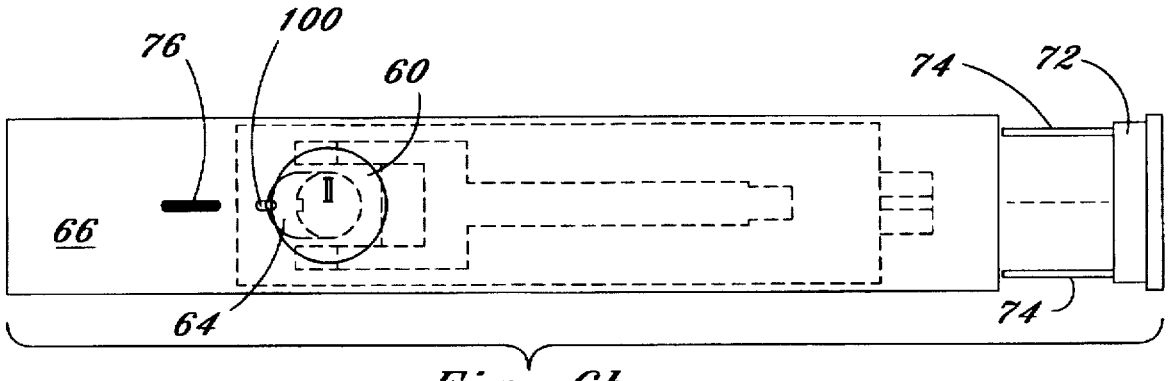
Figure 6C:
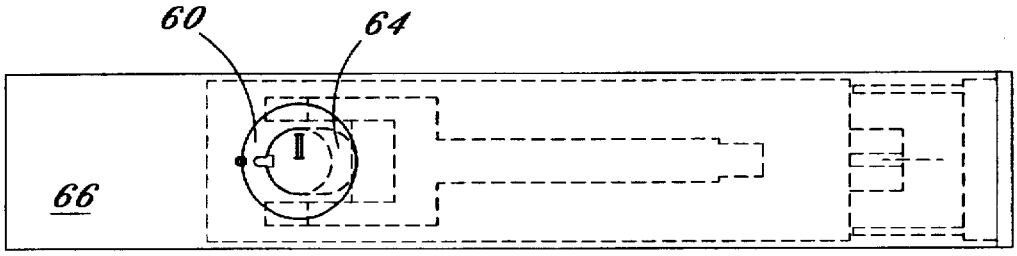
Figure 7A:
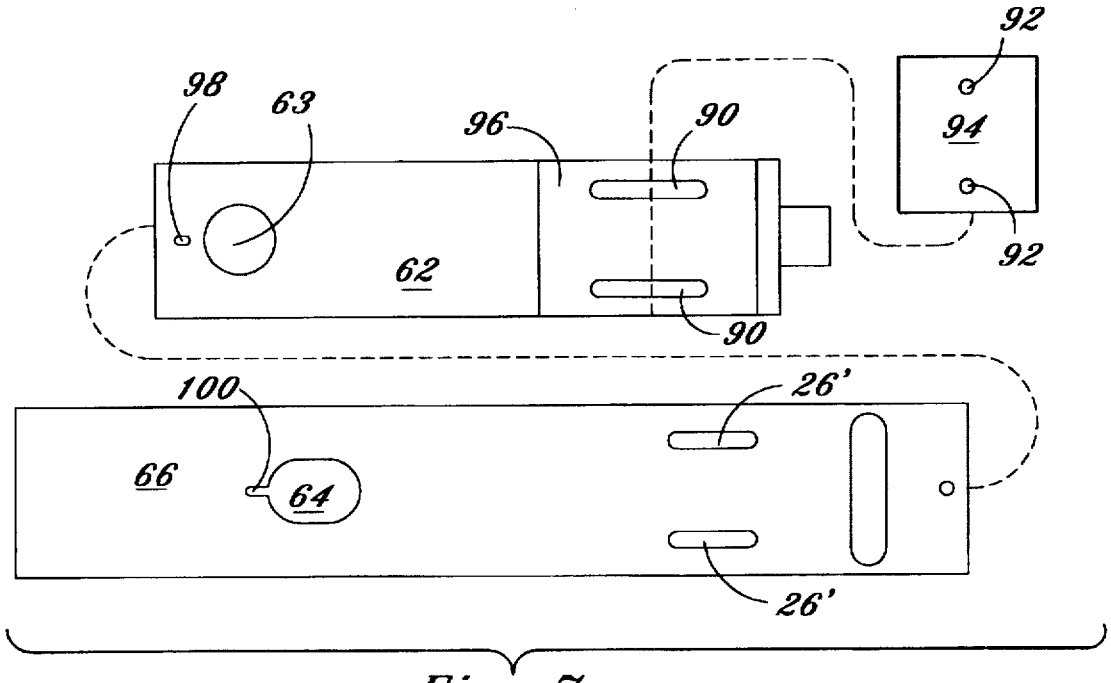
FIGS. 7A–C are rear elevational assembly views, of the embodiment of FIGS. 6A–C.
Figure 7B:
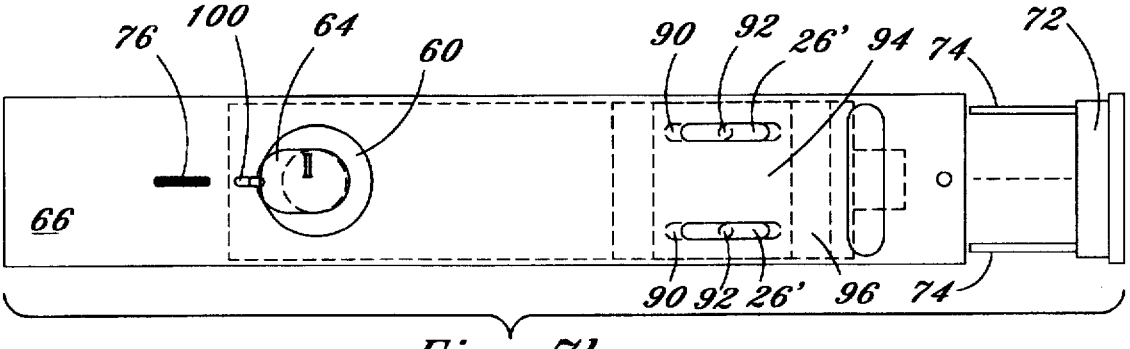
Figure 7C:
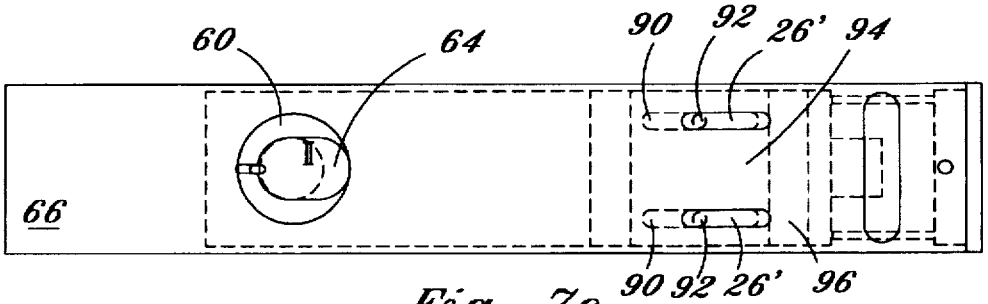

To disassemble the device, endcap 72 is first removed. Internal rigid member/cylinder lock/latchbolt assembly 70 is then slid inside hollow rigid bar 66 toward the end nearest removed endcap 72, (the latchbolt end). Assembly 70 slides until stopped by cylinder locks' 60 contact with the edge of the elongated apertures 64 in hollow rigid bar 66. As shown in FIGS. 6A–7C, recessed set screws 76, which must be removed to allow cylinder locks 60 to be unthreaded, are thereby uncovered. Recessed set screws 76, one for each cylinder lock 60, are hidden by the edges of cylinder locks 60 during use of the device, as shown in FIGS. 6C and 7C, and are only exposed when the rigid member/cylinder lock/latchbolt assembly 70 is slid toward the end that holds latchbolt 68, as shown in FIGS. 6B and 7B.

Set screws 76 pass through apertures 100 in hollow rigid bar 66 and are threaded into threaded apertures 98 in rigid member 62. Set screws 76 make contact with grooves 65 in cylinder locks 60, as shown in FIGS. 8 and 9, preventing cylinder locks 60 from being turned.

Once set screws 76 are removed, cylinder locks 60 can be unthreaded and removed, permitting internal rigid member 62 to be slid completely out of hollow bar 66. Assembly is the reverse of these steps, ending with insertion of endcap 72 which fixes the position of internal assembly 70 by pressure from positioning members 74.

Figure 8:
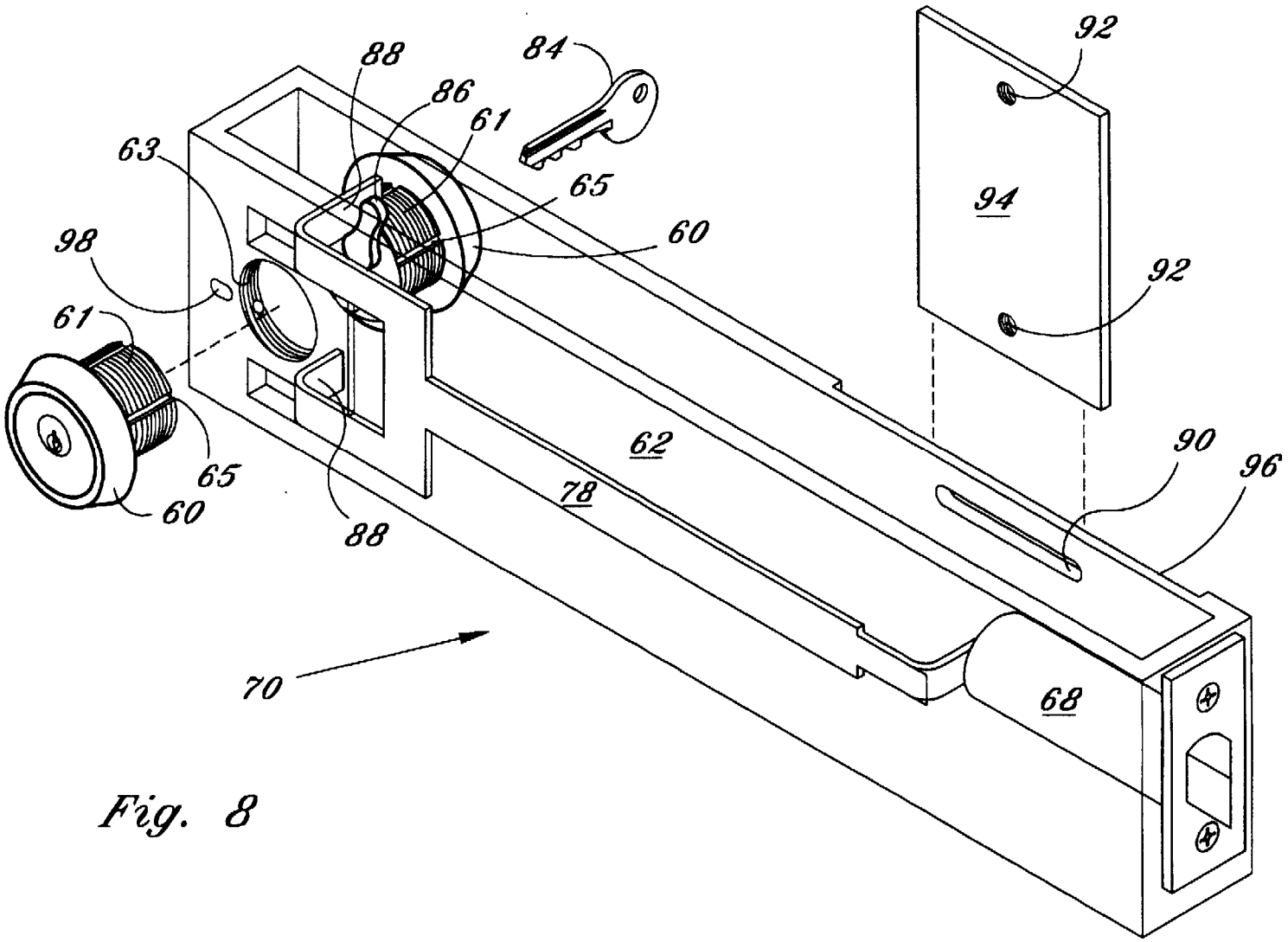
FIG. 8 is a perspective, partially exploded view of the cylinder locks, rigid linkage member, and latchbolt of the alternate embodiment of the present invention.
Figure 9:
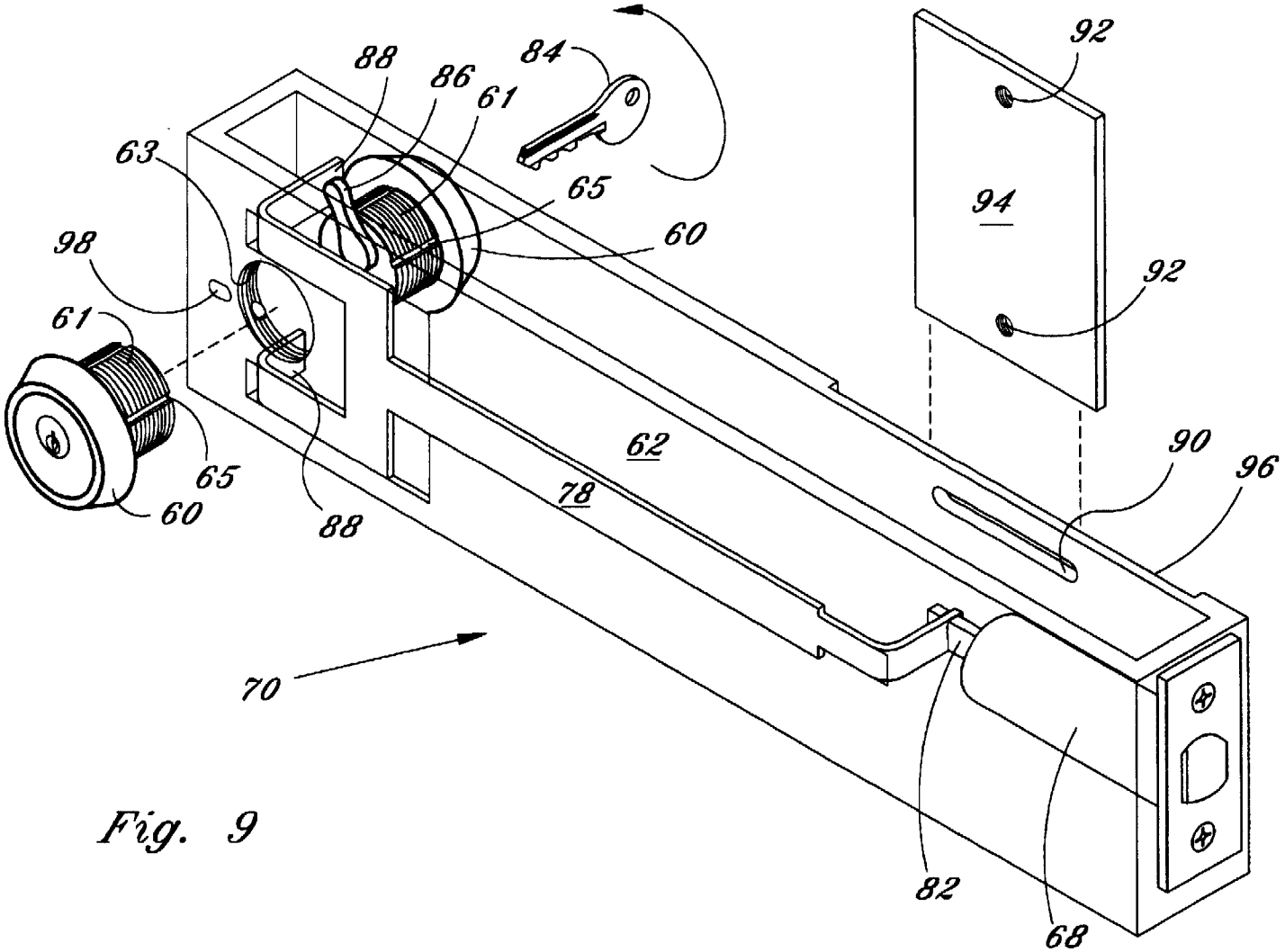
FIG. 9 is a perspective, partially exploded view as shown in FIG. 8 with the latchbolt in the open position.
Figure 10:
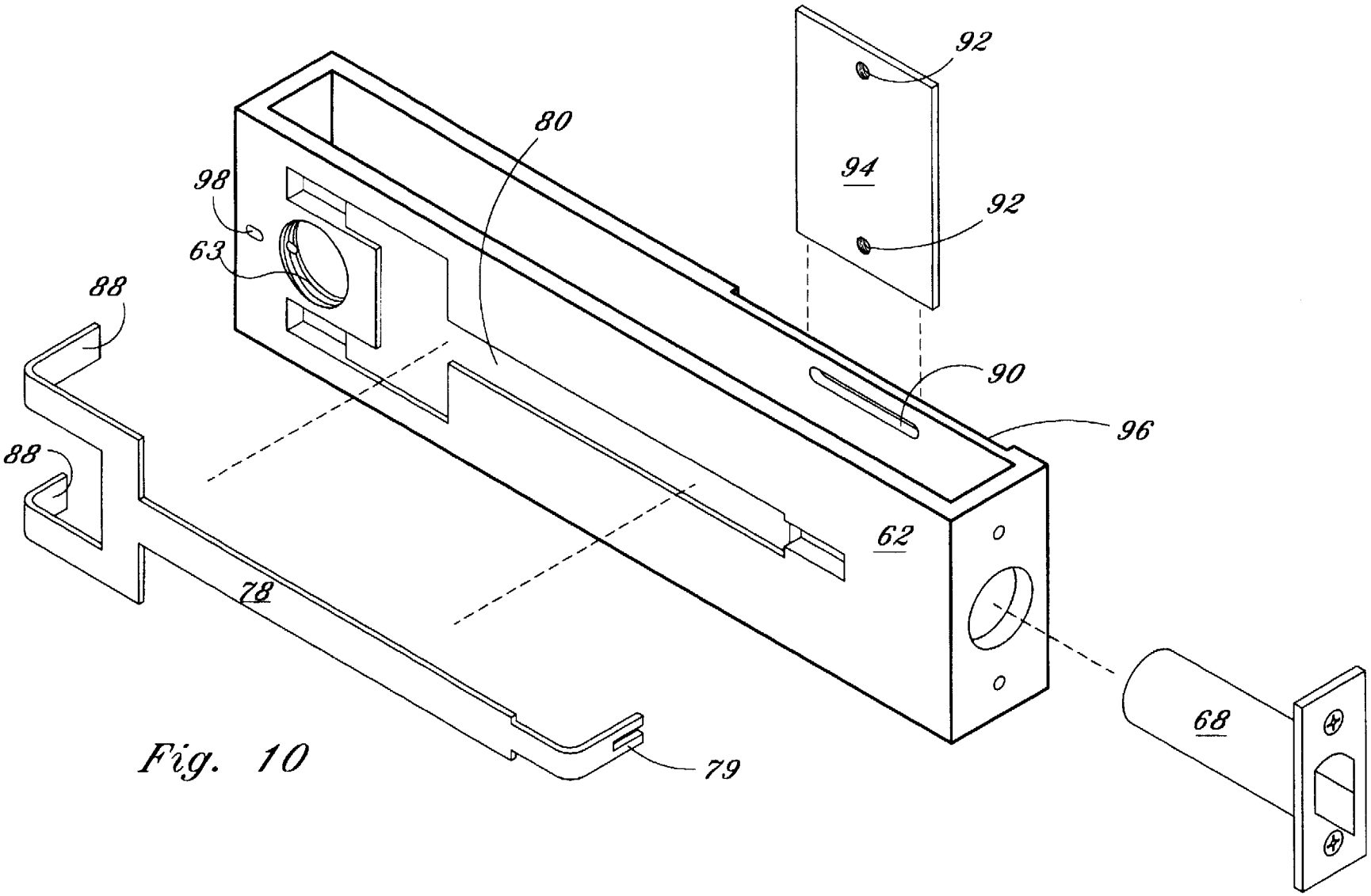
FIG. 10 is an exploded perspective view of the internal rigid member, the rigid linkage member, and the latchbolt of the alternate embodiment of the present invention.

Referring now to FIGS. 8–10, in the embodiment just described, cylinder locks 60 are connected to latchbolt 68 by rigid linkage member 78 which fits into recessed area 80 on internal rigid member 62. Rigid linkage member 78 is connected at end 79 to latchbolt 68 at clip 82, as shown in FIG. 9. Recessed portion 80 of internal rigid member 62 allows rigid linkage member 78 to slide longitudinally for the full movement of latchbolt mechanism 68. When a key 84 is rotated in either cylinder lock 60, a lever 86 on the inside of cylinder lock 60 rotates against end portion 88 of rigid linkage member 78, thereby pulling linkage 78 and opening latchbolt 68, as shown in FIG. 9. As in the previous embodiment, an internal spring mechanism (not shown) keeps latchbolt 68 in the closed position when key 84 is released, as shown in FIG. 8.

Figure 3:
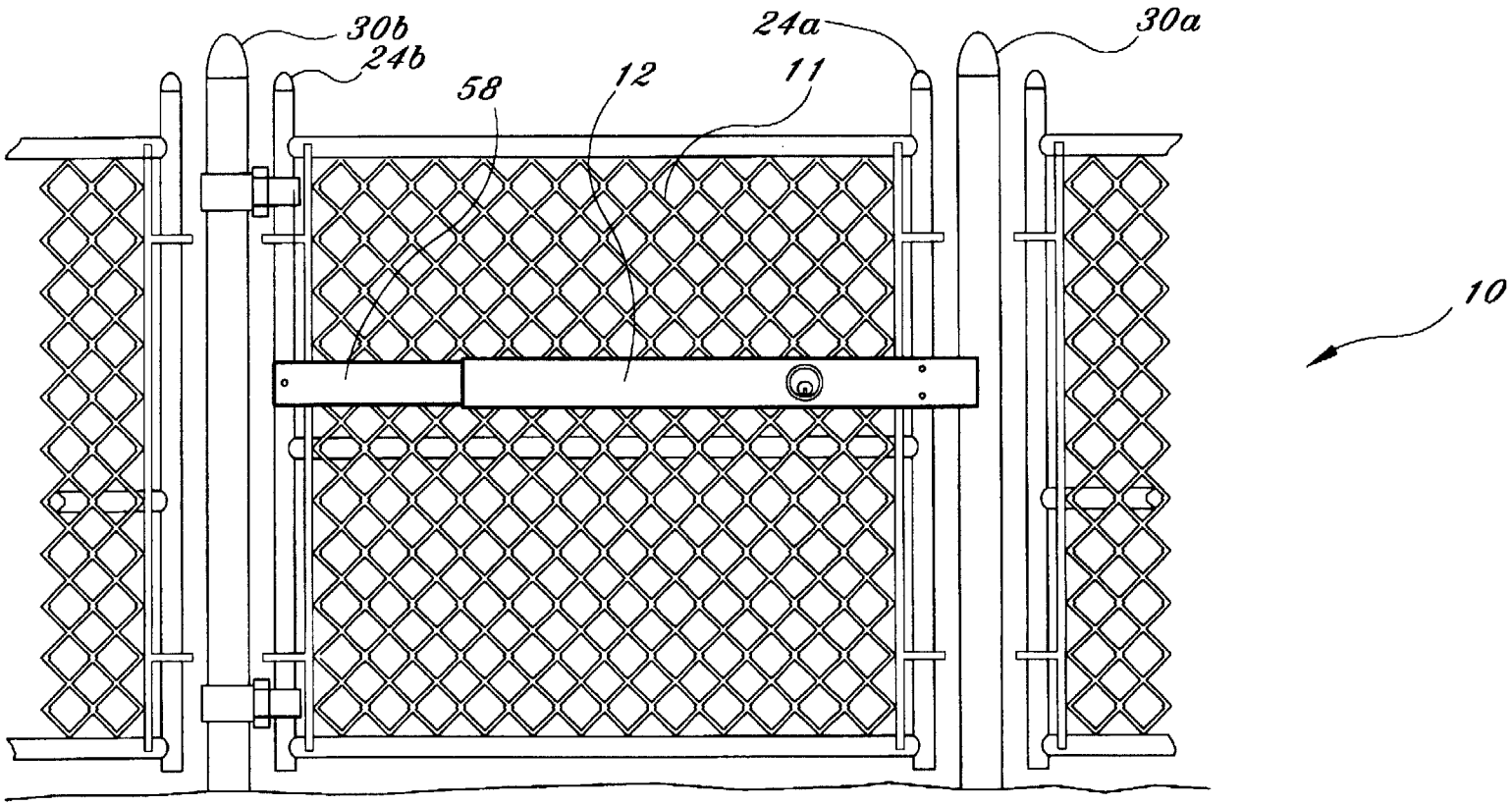
FIG. 3 is a diagrammatic view showing the device attached to a chain-link fence.
Figure 4:
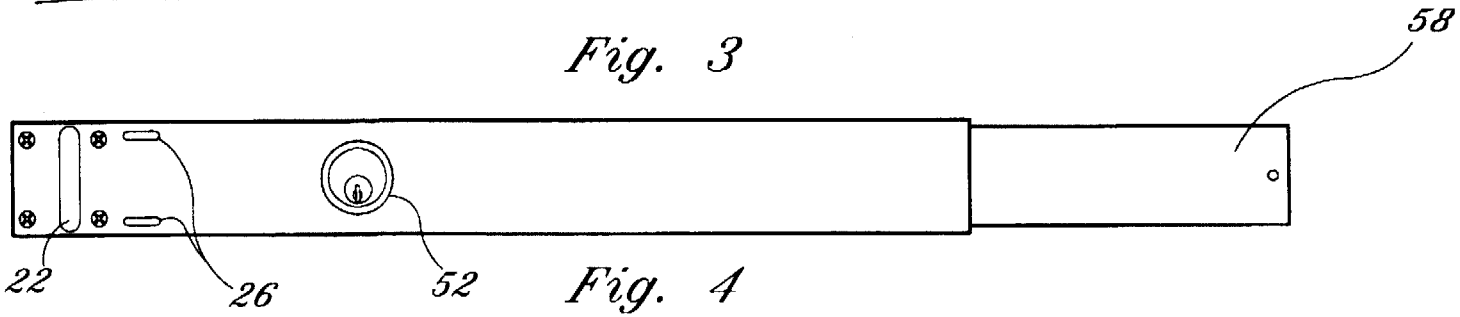
FIG. 4 is a side elevational view of the instant invention.

Mounting the embodiment of FIGS. 6A–10 on an gate is similar to that depicted in FIGS. 3 and 4. Rigid hollow bar 66 has elongated apertures 26', similar to those shown as 26 in FIG. 4, shown in FIGS. 7A–C. Internal rigid member 62 has elongated apertures 90 which align with the elongated apertures 26' of rigid hollow bar 66. Fasteners (not shown but similar to 28 shown in FIG. 2) thread into threaded apertures 92 of mounting plate 94. Mounting plate 94 fits into recessed area 96 of internal rigid member 62. Recessed area 96 is longer in the longitudinal direction than the length of mounting plate 94. Therefore, mounting plate 94 slides longitudinally, in recessed portion 96, for the full length of elongated apertures 90 providing slidable adjustment of the fasteners (not shown) used to secure the device to a gate.

The alternate embodiment of the present invention can be mounted in a "right-hand" manner, as shown in FIGS. 6A–10, or can be mounted in a "left-hand" manner, which is a mirror image of that depicted in FIGS. 6A–10.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A positive locking latchbolt mechanism for a movable closure such as a gate for a chain link fence of the type having at least one rigid fence support, comprising:

a rigid, hollow bar, said bar sized in length to fit substantially laterally from one side of the gate to the other;

means for attaching said rigid bar to the gate;

a rigid support bar slidely mounted inside said hollow bar;

a latchbolt mounted within said hollow rigid bar on said slidely mounted rigid support bar at a predetermined position, said hollow rigid bar having a locking aperture functionally disposed relative to said latchbolt;

means for unlocking said latchbolt mounted, through an elongated aperture in said hollow rigid bar, to said rigid support bar and connected to said latchbolt, wherein said means for unlocking, said latchbolt, and said slidely mounted rigid support bar are movable from a first position to a second position;

a removable end cap disposed in an end of said rigid bar, said end cap having means for positioning said slidely mounted rigid support bar in said first position;

means for removal of said means for unlocking accessible only when said means for unlocking is in said second position; and a strike plate capable of being attached to the rigid fence support at a predetermined location, said strike plate including at least one protruding portion having a latchbolt receiving aperture therein, said strike plate protruding portion including being sized to fit into the rigid bar locking aperture, said latchbolt being engagable within and retractable from the latchbolt receiving aperture when the gate is in a closed position.

2. A positive locking latchbolt mechanism as recited in claim 1, wherein said means for unlocking comprises:

a first key-actuated cylindrical locking mechanism connected through said elongated aperture in said hollow rigid bar to said slidely mounted rigid bar, said key-actuated locking mechanism including a key receiving portion disposed on an outside portion of said hollow rigid bar; and linkage means connecting said cylindrical locking mechanism to said latchbolt for moving said latchbolt between a first position and a second position, said latchbolt being biased to said first position and moved against the bias to a second position by actuation of a key within said cylindrical locking mechanism.

3. A positive locking latchbolt mechanism as recited in claim 2, wherein said linkage means includes:

a retracting lever pivotally connected to said cylindrical locking mechanism; and a retracting bar connected between said latchbolt and said retracting lever, said retracting bar slidely mounted on said slidely mounted rigid support bar.

4. A positive locking latchbolt mechanism as recited in claim 3, wherein said linkage means further comprising:

said retracting bar having a first angular portion engaging said retracting lever, and a second angular portion engaging said latchbolt;

such that when a key is placed within said key receiving portion and rotated, said retracting lever pivots and engages said retracting bar first angular portion, thereby causing said slidely mounted retracting bar to exert tension through said second angular portion on said latchbolt, causing said latchbolt to retract.

5. A positive locking latchbolt mechanism as recited in claim 2, wherein a second key-actuated cylindrical locking mechanism is connected, through a second elongated aperture in said hollow rigid bar, to said slidely mounted support bar, diametrically opposed from said first key-actuated cylindrical locking mechanism, each of said first and second key-actuated cylindrical locking mechanisms being connected to said linkage means.

6. A positive locking latchbolt mechanism as recited in claim 2, wherein said means for removal of said means for unlocking further comprising:

a threaded removable set screw connected, through an aperture in said hollow rigid bar, through a threaded aperture in said slidely mounted support bar, to said key-actuated cylindrical locking mechanism for preventing an individual from turning a cylindrical locking mechanism, thereby preventing the individual from unlocking the latchbolt mechanism by unthreading the cylindrical locking mechanism, said cylindrical locking mechanism being in said first position.

7. A positive locking latchbolt mechanism as recited in claim 1, wherein said means for positioning in said removable end cap includes at least one rigid spacer attached to said end cap, said spacer biasing said slidely mounted rigid bar in said first position when said end cap is disposed in the end of the hollow rigid bar.

* * * * *